United States Patent [19]

Mabuchi

[11] Patent Number: 4,565,189

[45] Date of Patent: Jan. 21, 1986

[54] BEAUTY TREATMENT DEVICE

[75] Inventor: Kenichi Mabuchi, Matsudo, Japan

[73] Assignee: Bio Mabuchi Co. Ltd., Japan

[21] Appl. No.: 423,157

[22] Filed: Sep. 24, 1982

[30] Foreign Application Priority Data

Oct. 8, 1981 [JP] Japan ..... 56-160653

[51] Int. Cl.[4] ..... A61H 7/00

[52] U.S. Cl. ..... 128/49; 128/52; 128/57; 74/425

[58] Field of Search ..... 128/24.3, 36, 52, 55, 128/57, 60, 49; 74/86, 87, 425

[56] References Cited

U.S. PATENT DOCUMENTS 1,455,320 5/1923 Ashlock ..... 128/52

3,003,497 10/1961 Nunes ..... 128/57

3,878,837 4/1975 Werding ..... 128/57

4,088,128 5/1978 Mabuchi ..... 128/52

*Primary Examiner*—Richard J. Apley

*Assistant Examiner*—David J. Brown

*Attorney, Agent, or Firm*—McGlew and Tuttle

[57] ABSTRACT

A beauty treatment device having a device body, a drive unit provided in the device body and a patter driven by the drive unit wherein the patter is composed of a freely rotating roller; and freely rotating space guide wheels for maintaining the range of patting motion of the roller by depressing an object being patted, and roller supports disposed on an axis coinciding with the center of the space guide wheels for supporting the shaft of the roller off-center with respect to the space guide wheels, so that the patter pats the object being patted.

10 Claims, 18 Drawing Figures

BEAUTY TREATMENT DEVICE

BACKGROUND OF THE INVENTION

1. Field of the Invention

This invention relates to a beauty treatment device, and more particularly a beauty treatment device having freely rotating space guide wheels for causing a freely rotating roller as a patter to make an up and down motion while describing an eccentrical circular orbit and maintaining the patting depth by the roller at a predetermined distance wherein the roller is caused to repeatedly pat the skin surface at an effective rate to remove subcutaneous adipose tissues and stimulate subcutaneous muscular layers to prevent the skin from being loosened; and the patter is adapted to move smoothly along the skin surface while making a patting motion.

2. Description of the Prior Art

It is widely practiced as a beauty treatment, particularly as a facelifting technique to tap or pat the skin surface with fingertips and other means. And, various massagers have heretofore been used, which give vibrations to the skin surface or lightly tap the human body. Most of those beauty treatment devices which give vibrations to the skin, however, involve the massaging of the skin by depressing the skin surface or giving a circular motion to the skin. These devices may cause the skin to stretch, leading to the loosening of the skin or even wrinkles in extreme cases.

The present inventor has already proposed a beauty treatment device which repeatedly gives gentle impacts on the skin surface. That is, the beauty treatment device previously proposed by the present inventor has a space guide fixedly mounted on a device body, and a patter fitted to an actuator which is caused to reciprocate by a drive unit so that the patter advances toward the open end of the space guide to pat the skin surface at a given rate. Although this type of beauty treatment device has a facelifting effect of removing subcutaneous adipose tissues, it has the following disadvantage. That is, when the user wants to change the patting position, he has to detach the device from the skin and then replace it at a desired position partly because the space guide is fixedly mounted on the device body and partly because the patter is adapted to make an up and down reciprocating motion. That is, if the user changes the patting position while applying the device onto the skin surface, the skin is unwantedly stretched sideways.

SUMMARY OF THE INVENTION

This invention is intended to overcome the aforementioned shortcomings.

It is the primary object of this invention to improve on the beauty treatment device previously proposed by the present inventor and provide a beauty treatment device having the same beauty treatment effect as obtained with the previously proposed beauty treatment device and adapted to be freely moved over the skin surface to desired positions while making patting motion onto the skin surface without causing unwanted strains to the skin.

It is another object of this invention to provide a beauty treatment device adapted to cause a patter to hit the skin surface at an effective rate so as to give impacts to the skin surface.

It is a further object of this invention to provide a beauty treatment device wherein the distance between a device body and the skin surface is maintained by space guide wheels, and a roller having a cushioning member, such as a sponge, on the outer surface thereof is caused to slightly protrude the edges of the space guide wheels in the radial direction by the circular orbital motion of the shaft of the roller so that the roller lightly pats the skin surface.

It is a further object of this invention to provide a beauty treatment device wherein the roller proper is rotatably fitted to the roller shaft via a bearing so as to permit the roller to freely rotate.

It is a further object of this invention to provide a beauty treatment device wherein the space guide wheels are adapted to freely rotate on an axis coinciding with the rotation center of roller supports so that the patting posltion of the roller is freely changed while making the patting motion.

It is a further object of this invention to provide a beauty treatment device wherein one piece of roller each is provided on both sides of a roller support so that the two rollers pat both wings of the nose.

It is a further object of this invention to provide a beauty treatment device wherein a cushioning member is provided on the outer surface of the roller so that the effect of patting is softened.

It is a further object of this invention to provide a beauty treatment device wherein the roller is supported at both end faces thereof by resilient cushioning rubber materials so as to mitigate impacts onto the skin surface.

It is a further object of this invention to provide a beauty treatment device wherein the roller itself or the cushioning member covering the outer surface of the roller is formed into non-cylindrical shapes having irregular surfaces so as to give variations to the patting intensity as well as to the patting depth at a given patting position to enhance the beauty treatment effect of the device.

These and other objects and advantages of the invention may be readily ascertained by referring to the following description and appended drawings.

DETAILED DESCRIPTION OF THE EMBODIMENT

Figure 2:
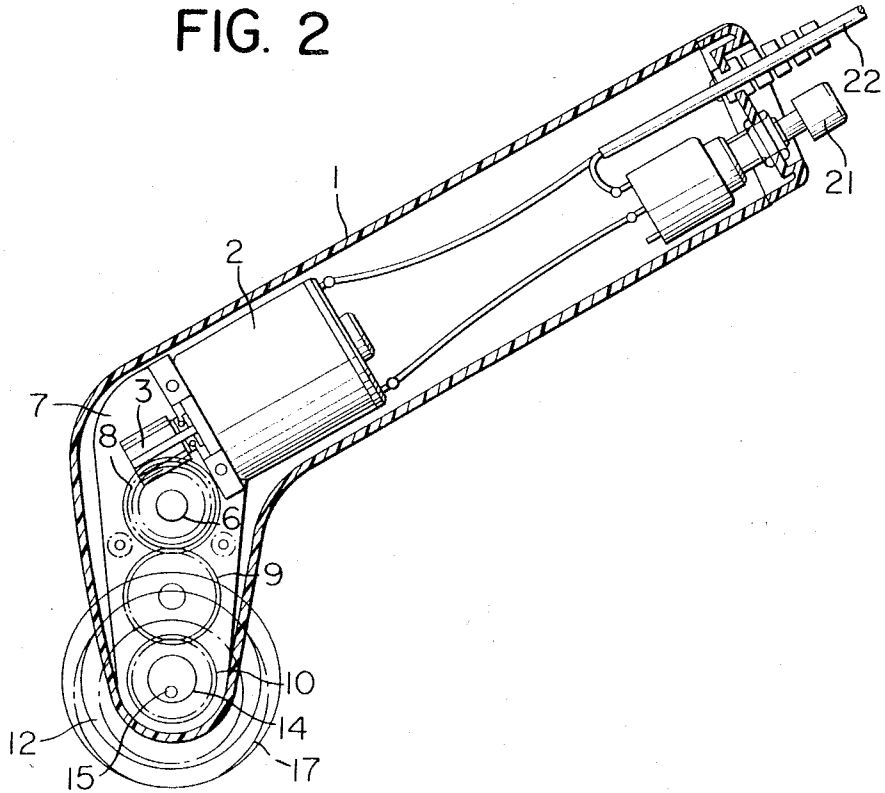
FIG. 2 is a cross-sectional side view of the embodiment shown in FIG. 1.

In FIGS. 1 through 10, reference numeral 1 refers to a device body; 2 to a motor as a drive unit; 3 to a worm gear fitted to an output shaft of the motor 2; 4 to a worm wheel; 5 to a transmission shaft; 6 to a bearing of the transmission shaft 5; 7 to a gear housing; 8 to a spur gear; 9 to an idle gear; 10 to a spur gear; 11 to a screw for connecting the spur gear 13 to the roller support 14; 12 to a freely rotating space guide wheel; 13 to a bearing; 14 to a roller support; 15 to a roller shaft; 16 is a roller as a patter; 17 to a sponge; 18 to a cushioning rubber; 19 to a bearing for the roller shaft 15; 20 to a spring; 21 to a power switch; and 22 to a power cord, respectively.

Figure 1:
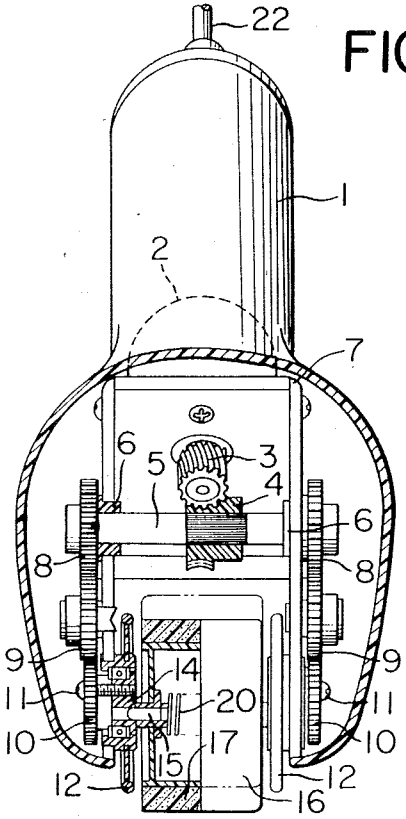
FIG. 1 is a cross-sectional front view of a beauty treatment device embodying this invention.
Figure 3:
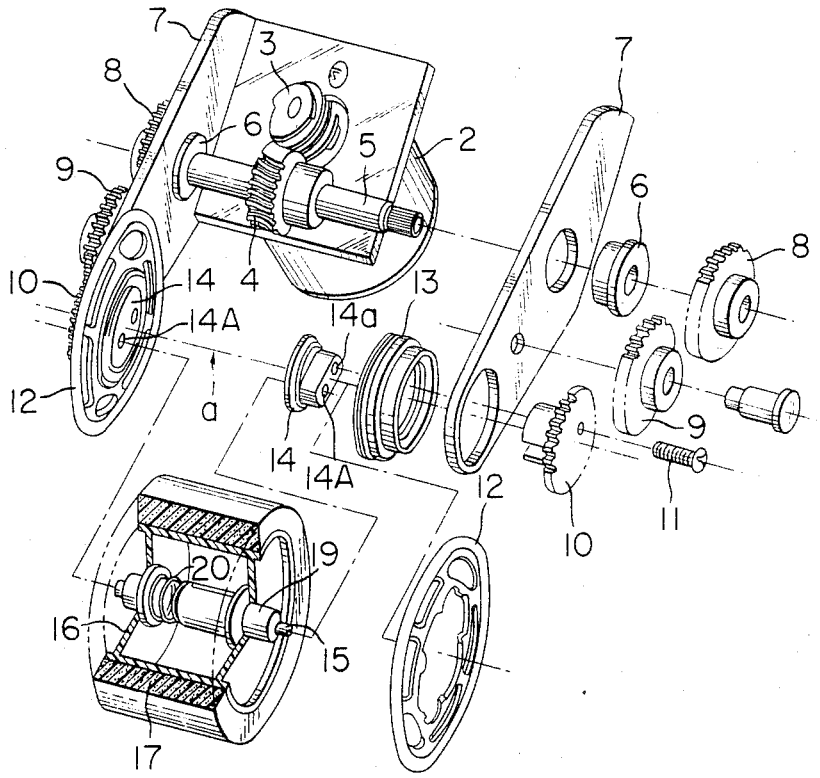
FIG. 3 is a diagram of assistance in explaining the construction of the embodiment shown in FIGS. 1 and 2.
Figure 4:
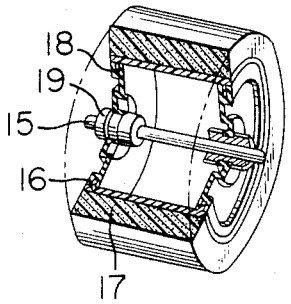
FIG. 4 is a diagram of assistance in explaining another modification of the roller used in this invention.

In the embodiment shown in FIGS. 1 through 3, the device body 1 is of a size affording a grip by the hand for pressing onto the skin to be treated. The motor 2 incorporated in the device body 1 is caused to rotate by supplying electric power via the power cord 22 by depressing the power switch 21, and is caused to stop by depressing again the power switch 21. The rotation of the motor 2 is transmitted to the transmission shaft 5 via the worm gear 3 and the worm wheel 4. The transmission shaft 5 is rotatably supported by the gear housing 7 via the bearing 6. As the transmission shaft 5 rotates, the spur gear 8 fitted to both ends of the transmission shaft 5 is caused to rotate. The rotation of the spur gear 8 is transmitted to another spur gear 10 via the idle gear 9. The spur gear 10 is rotatably supported by the gear housing 7 via the bearing 13, as shown in FIG. 3, and is connected to the roller support 14 by the screw 11 in a state where a part of the spur gear 10 engages with the roller support 14. Consequently, as the spur gear 10 rotates, the roller supports 14 are also caused to rotate. On each of the roller supports 14, provided is an off-center hole 14A for supporting the shaft 15 of the roller 16, into which the shaft 15 is inserted. Consequently, as the roller supports 14 rotate, the shaft 15 is caused to make an orbital motion, describing a circular orbit having a radius equal to the distance between the off-center hole 14A and the rotation center of the roller support 14, that is, the amount of eccentricity. The space guide wheels 12 are fitted in such a manner that the rotation center of the wheels 12 agrees with the rotation center of the roller supports 14, and that the space guide wheels 12 are allowed to freely rotate. It is desirable to make the outside diameter of the space guide wheels 12 slightly smaller than the outside diameter of the roller 16, which will be described later. The roller 16 proper is freely rotatably fitted to the shaft 15 via the bearing 19, with a cushioning member, such as the sponge 17 of an appropriate thickness, provided on the outer circumferential surface thereof. The roller 16 may be supported at both end faces thereof by a resilient member 18, such as the cushioning rubber, as shown in FIG. 4.

The aforementioned construction makes it possible that, when a user depresses the power switch 21 to drive the motor 2, the roller shaft 15 is caused to make an orbital motion, and the roller 16 is also caused to make an orbital motion, describing a circular orbit. In this case, however, the rotation of the motor 2 does not directly affect the rotation of the roller 16 around the axis thereof since the roller 16 is allowed to freely rotate by the bearing 19. When the beauty treatment device described above is pressed upon the skin being treated, impacts of an appropriate strength are given onto the skin by the orbital motion of the roller 16 while an appropriate distance is maintained between the skin surface and the device body 1 by the space guide wheels 12. During treatment, both the sponge 17 and the cushioning rubber 18 serve as cushions to mitigate sharp impacts on the skin. The roller 16, which makes a circular orbital motion, exerts a massaging force in the longitudinal direction (that is, in the direction perpendicular to the skin surface), rather than in the lateral direction (that is, in the direction parallel to the skin) because the roller 16 is freely rotatably fitted, as described above. Thus, the roller 16 repeatedly pats the skin surface with a flipping touch. Furthermore, the space guide wheels 12, which are permitted to freely rotate independently of the rotation of the motor 2, allows the patting position to be moved along the skin surface as desired while exerting patting force onto the skin. That is, the patting position can be changed smoothly by skidding the device body 1 sideways by the hand holding the device body 1 to cause the space guide wheels 12 to rotate.

Figure 6:
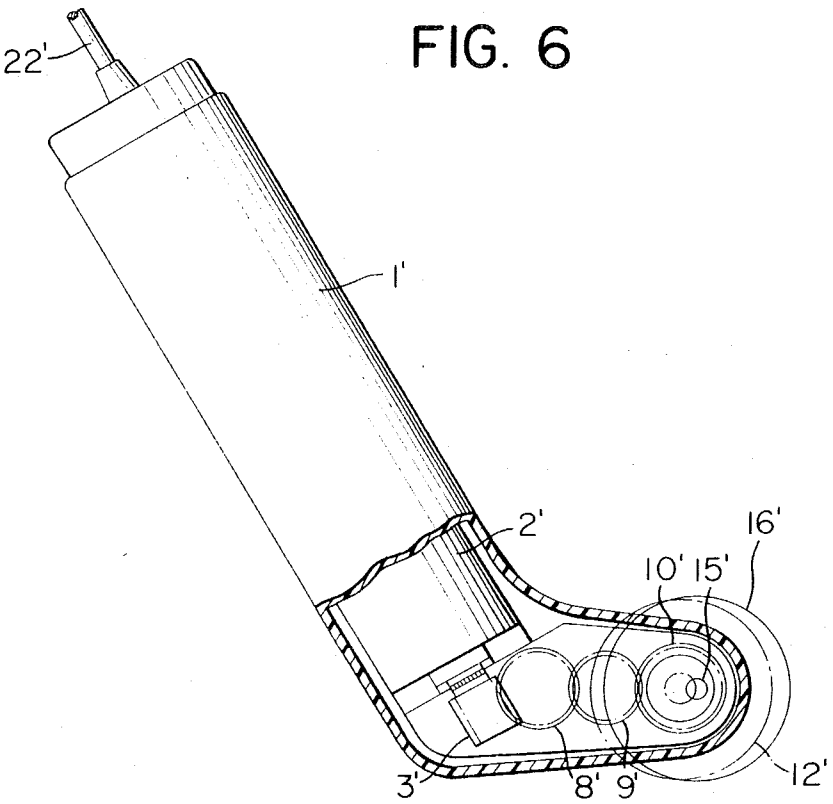
FIG. 6 is a partially cross-sectional side view of the embodiment shown in FIG. 5.
Figure 5:
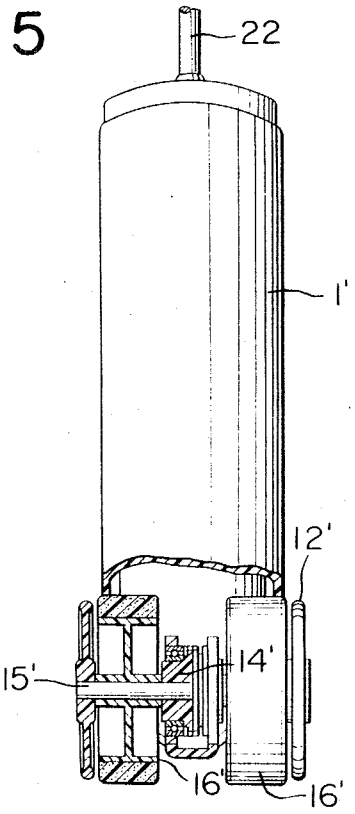
FIG. 5 is a partially cross-sectional front view of another embodiment of this invention.
Figure 7:
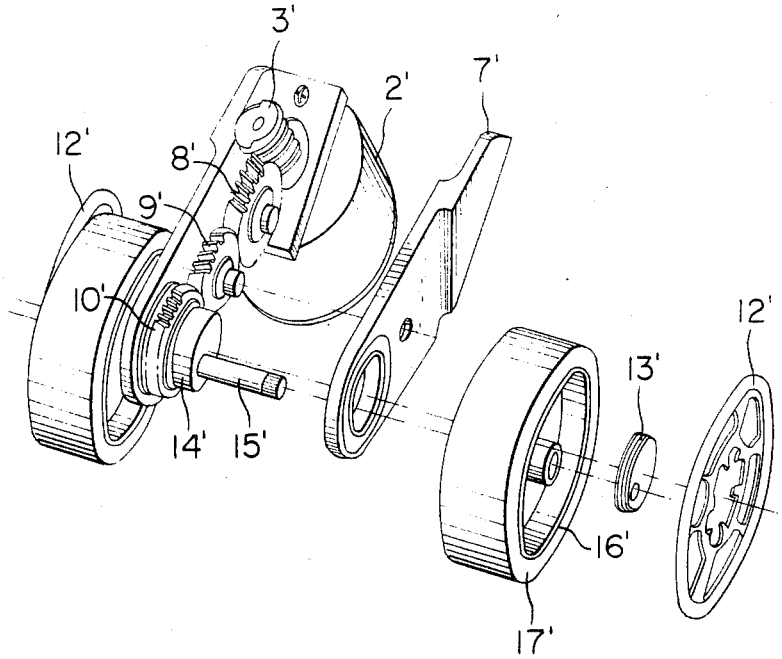
FIG. 7 is a diagram of assistance in explaining the construction of the embodiment shown in FIGS. 5 and 6.

FIGS. 5 through 7 show another embodiment of this invention, where two pieces of rollers 16' are provided, with a roller support 14' interposed between the rollers 16'. This construction is convenient in simultaneously massaging the wings of the nose. In this embodiment, the rotation of a motor 2' causes a helical gear 8' to rotate via a worm gear 3', and the rotation of the helical gear 8' is transmitted to a helical gear 10' via an idle gear 9'. Although the rotation of the helical gear 10' causes the roller support 14' to rotate, the shaft 15' makes a circular orbital motion of a radius equal to the amount of eccentricity since the roller shaft 15' is disposed off-center with respect to the roller support 14', as in the case of the aforementioned embodiment. Consequently, the roller 16' freely rotatably fitted to the shaft 15' is also caused to make an orbital motion. The space guide wheels 12' are freely rotatably fitted to the outside of the two rollers 16' via wheel bearings 13' so as to permit the patting position of the rollers 16' to be changed while making patting motion.

Figure 8B:
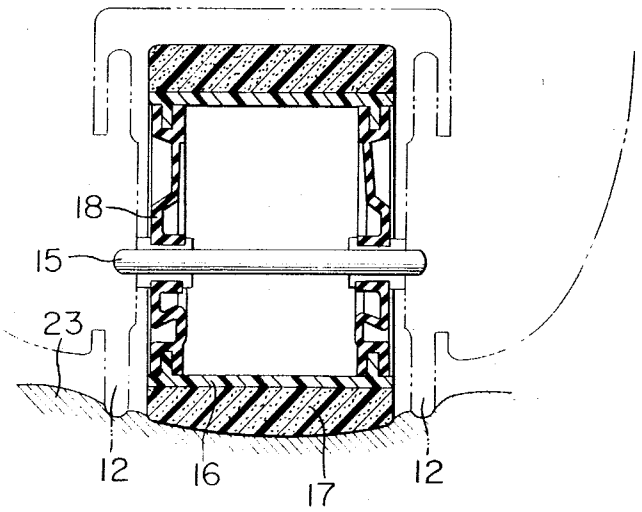
FIG. 8 is a diagram of assistance in explaining the roller cushioning mechanism of the beauty treatment device according to this invention.
Figure 8A:
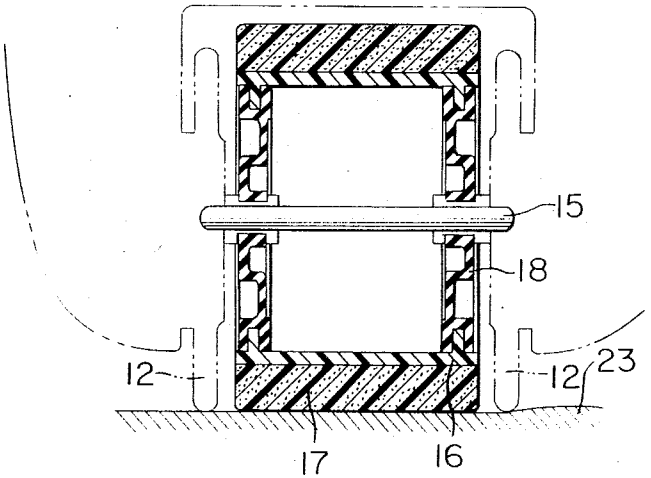
Figure 9A:
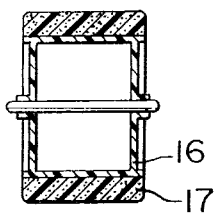
FIGS. 9 and 10 are cross-sectional views of various modifications of the roller used in the beauty treatment device according to this invention.
Figure 9B:
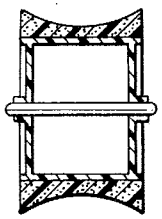
Figure 9C:
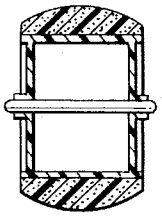
Figure 9D:
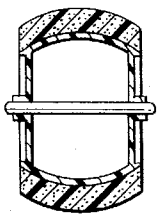
Figure 9E:
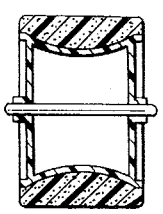
Figure 10A:
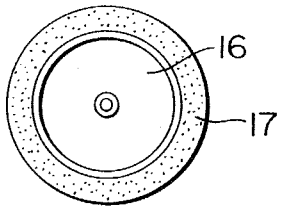
Figure 10B:
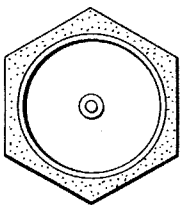
Figure 10C:
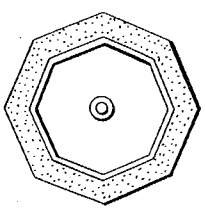
Figure 10D:
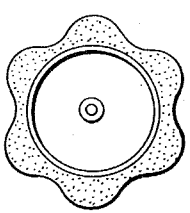

FIG. 8 is a cross sectional view of the roller 16' in operation to facilitate the understanding of the roller cushioning mechanism of the beauty treatment device shown in FIG. 1. Reference numerals 15 through 18 in the figure correspond with like numerals in FIG. 1, and numeral 23 refers to an object being patted.

When the beauty treatment device embodying this invention is pressed gently onto the object being patted 23, as shown in FIG. 8 (A), the pushing force exerted onto the object being patted 23 by the beauty treatment device proper is relatively small and the impacts exerted onto the object being patted 23 by the circular orbital motion of the roller 16 are also small. The cushioning rubber 18 is not so remarkably deflected, nor is the sponge 17 compressed materially.

When the beauty treatment device of this invention is pressed strongly onto the object being patted 23, on the other hand, the beauty treatment device proper strongly presses the object being patted 23, and the roller 16 exerts a large force onto the object being patted 23 when the circular motion of the roller shaft 15 reaches the bottom dead center thereof, as shown in FIG. 8 (B). In this case, however, the cushioning rubber 18 is deflected and the sponge 17 is compressed in accordance with the magnitude of the force received, with the consequence that the skin is subjected to a large flipping force, rather than a sharp impacting force. As a result, the user can achieve the patting effect of a desired magnitude by pressing the beauty treatment device onto the object being patted 23 with an appropriate force. Even when the device is pressed too strongly by mistake, the cushioning effect of the cushioning rubber 18 and the sponge 17 never cause strains to the skin.

FIGS. 9 (A) through (E) show a cross-sectional front views of various modifications of the roller 16. When the thickness of the sponge 17 is made uniform, as shown in FIG. 9 (A), the object being patted 23 is subjected to a virtually uniform force at all times. The thickness of the sponge 17 may be made thicker on the outer edges thereof than the thickness on the middle part thereof, or vice versa, as shown in FIG. 9 (B) or (C). In such cases, the thicker portion of the sponge 17 not only gives a stronger patting effect on the object being patted but also exerts a stronger cushioning effect against impacts, and the thinner portion thereof gives the opposite effect. Furthermore, the diameter of the outer circumferential surface of the roller 16 proper may be varied at the outer edges and the middle part thereof. In this way, by varying the shape of the roller 16 proper or the sponge 17, the patting depth, impacting strength, etc. at each portion of the roller 16 may be varied. It is desirable, therefore, to provide several types of rollers, as shown in FIGS. 9 (A) through (E), so as to permit the user to select the most suitable roller according to the patting positions, such as the face, the shoulder, etc.

FIGS. 10 (A) through (D) show cross-sectional side views of various modifications of the roller 16. The outer periphery of the roller 16 and the sponge 17 may be formed into a circular shape in cross-section, as shown in FIG. 10 (A), or only the sponge 17 may be formed into a polygonal shape in cross-section, as shown in FIG. 10 (B), or both the roller 16 proper and the sponge 17 may be formed into a polygonal cross-section, as shown in FIG. 10 (C). As the roller 16 proper is allowed to freely rotate, whether the object being patted is pressed by the corner or flat portion of the sponge 17 is not certain, particularly in the case of FIG. 10 (B) or (C). The roller 16 having the sponge 17 of such shapes, however, can exert an impacting force of varying degrees, compared with the sponge 17 having a cross-section shown in FIG. 10 (A). Furthermore, the sponge 17 may be formed in such a manner that the sponge 17 covers the outer surface of roller 16 proper in a corrugated form, as shown in FIG. 10 (D). Needless to say, it is desirable to provide several types of rollers so as to permit the user to select the most suitable roller according to the portion being treated, as in the case of the modifications shown in FIGS. 9 (A) through (E).

As described above, this invention makes it possible to remove subcutaneous adipose tissues and stimulate subcutaneous muscular tissues to prevent the skin surface to be loosened by causing the roller as a patter to make an eccentrical circular motion at a predetermined rate, whereby causing the roller to repeatedly pat the skin surface. The patting intensity can be changed to an appropriate level by changing the pressure exerted onto the skin surface by the device body. Furthermore, the patting position of the roller can be changed to a desired position while exerting patting action since the space guide wheels are allowed to freely rotate.

It is claimed:

1. A beauty treatment device, comprising a device body, a drive unit in said body, a roller support rotatably mounted in said body about a support axis, a patter having a shaft rotatably mounted on said roller support about a shaft axis, said shaft axis being offset from said support axis so that said shaft is eccentrically mounted on said roller support for eccentric rotation relative to said roller support, said patter having an outer periphery with a diameter which is driven through an eccentric path, a bearing rotatably mounted in said device body for rotation about said support axis, means connecting said drive unit to said roller support for rotating said roller support, and a spacer wheel rotatably mounted on said bearing and being of a diameter at most smaller than the diameter of said outer periphery of said patter so as to engage against the skin and position the device so that rotation of said patter causes said patter to pat the skin.

2. A beauty treatment device according to claim 1, including a transmission shaft having a transmission shaft gear, said drive unit including a motor having a motor shaft with a gear engaged with said transmission shaft gear for rotation of said transmission shaft, said body having a housing plate portion on each side of said transmission shaft rotatably supporting said transmission shaft, and transmission gear means extending from said transmission shaft to said roller support and effecting rotation of said roller support with rotation of said motor shaft.

3. A beauty treatment device as set forth in claim 1 wherein said roller support comprises which are provided in such a manner as to support both ends of said shaft.

4. A beauty treatment device as set forth in claim 1 wherein said drive unit consists of a motor and a plurality of gears provided in multi-stages for transmitting the rotation of said motor to said roller supports.

5. A beauty treatment device as set forth in claim 4 wherein said gears in said drive unit consist of a worm gear fixedly fitted to a rotating shaft of said motor, a worm wheel in mesh with said worm gear, a worm shaft to which said worm wheel is fixedly fitted, a first spur gear fixedly fitted to sail worm shaft, an idle gear in mesh with said first spur gear, and a second spur gear in mesh with said idle gear to drive said roller support.

6. A beauty treatment device as set forth in claim 1 wherein said patter is supported at both end faces thereof by resilient cushioning rubber.

7. A beauty treatment device according to claim 1, wherein said patter comprises a roller having a cylindrical surface.

8. A beauty treatment device according to claim 7, wherein said cylindrical surface of said patter is of uniform diameter.

9. A beauty treatment device as set forth in claim 1, wherein said patter includes two separate patter portions which are spaced with respect to said shaft axis, said roller support being disposed between said patter portions.

10. A beauty treatment device according to claim 1, wherein said patter includes an outer cushion portion which carries said outer periphery.

* * * * *